US005363953A

United States Patent [19]

Carter

[11] Patent Number: 5,363,953

[45] Date of Patent: Nov. 15, 1994

[54] FLEXIBLE JEWELRY DISPLAY AND STORAGE DEVICE

[76] Inventor: Sandy Carter, 10730 SW. Black Diamond Way, Tigard, Oreg. 97223

[21] Appl. No.: 897,440

[22] Filed: Jun. 12, 1992

[51] Int. Cl.[5] ..... B65D 73/00

[52] U.S. Cl. ..... 206/6.1; 206/495; 206/806; 383/11; 383/24; 383/90

[58] Field of Search ..... 206/6.1, 225, 495, 486, 206/566, 806; 383/17, 38, 39, 11, 24, 90; 229/87.01

[56] References Cited

U.S. PATENT DOCUMENTS

| | | | |
|---|---|---|---|
| 3,139,133 | 6/1964 | Spector | 383/40 X |
| 3,339,874 | 9/1967 | Kerstens . | |
| 3,458,163 | 7/1969 | Egerton-Smith . | |
| 3,678,607 | 7/1972 | Tabor et al. . | |
| 3,885,333 | 5/1975 | Zachary . | |
| 3,957,157 | 5/1976 | Therrien . | |
| 4,023,674 | 5/1977 | Manley . | |
| 4,043,449 | 8/1977 | Love . | |
| 4,181,224 | 1/1980 | Aber . | |
| 4,223,783 | 9/1980 | Marshall | 206/225 X |
| 4,287,986 | 9/1981 | Beck . | |
| 4,311,235 | 1/1982 | Titus . | |
| 4,324,446 | 4/1982 | LeSage . | |
| 4,401,219 | 8/1983 | Mink | 206/6.1 X |
| 4,413,736 | 11/1983 | Nibling . | |
| 4,420,084 | 12/1983 | Whelan . | |
| 4,422,250 | 12/1983 | Golan . | |
| 4,465,179 | 8/1984 | Miller . | |
| 4,548,375 | 10/1985 | Moss | 383/24 X |
| 4,549,366 | 10/1985 | Gerdling et al. . | |
| 4,606,458 | 8/1986 | Labate . | |
| 4,687,103 | 8/1987 | Corbett . | |
| 4,821,883 | 4/1989 | Miller | 206/495 |
| 4,865,097 | 9/1989 | Allen | 206/495 X |
| 4,905,821 | 3/1990 | Corbett . | |
| 5,121,833 | 6/1992 | Lindsay et al. | 206/486 X |

*Primary Examiner*—Jacob K. Ackun, Jr.
*Attorney, Agent, or Firm*—Keith A. Cushing

[57] ABSTRACT

A flexible jewelry display, storage, and transportation device includes a flexible screen or mesh for receiving the shaft or hook-like structures of jewelry items for display or storage. The mesh is surrounded by a flexible decorative fabric frame whereby the entire assembly may be rolled into cylindric configuration for storage or transportation of an inventory of jewelry items. Fastening devices are provided for maintaining the device in rolled configuration and for attaching the device for display or storage.

6 Claims, 2 Drawing Sheets

FLEXIBLE JEWELRY DISPLAY AND STORAGE DEVICE

BACKGROUND OF THE INVENTION

The present invention relates generally to cosmetic accessories, and particularly to a display, storage and transportation device for jewelry items.

Earrings are used as personal ornaments by both men and women in cultures as diverse as modern American and Pygmy tribes. In America, pierced earrings have increasingly gained favor throughout the 1980s and into the 1990s and are now worn by both sexes, all ages from birth to centenarians, and across all socio-economic classes. For many persons, the use of earrings provides a form of personal ornamentation which may vary frequently according to the person's dress or mood. Many people have a great variety and number of earrings and select from this inventory on a daily basis. Thus, storage, display and, for travelers, transportation of an organized inventory of earrings is desirable.

Storage of earrings, is a problem because earrings have an inherent tendency to become separated from one another, i.e., matched pairs separated, or entangled with each other, or lose their attaching backs such as used for "post" style earrings. This is a constant problem, especially for people with a large inventory and high frequency of use. As American women, for example, enter the labor market in ever-increasing numbers and their increased discretionary income is used to complement their professional wardrobes, many women have developed enormous inventories of earrings which need to be available on a daily basis, appropriately stored, and, for those who travel, suitably transported without risk of loss, separation, or damage.

U.S. Pat. No. 4,606,458 teaches a framed display surface comprising a flexible mesh screen for receiving and holding an article to be displayed and a pair or inter-dependent coaxially arranged hoops supporting the flexible mesh screen within a plane. The flexible mesh screen is then retained between the hoops by an annular band of decorative material between the hoops.

U.S. Pat. No. 4,905,821, issued Mar. 6, 1990 to Mary D. Corbett and entitled JEWELRY DISPLAY DEVICE shows a rectangular device for displaying or storing jewelry such as pierced earrings, medals, name tags and like items having a decorative front portion and a back portion having at least one pin-like shaft, post or hook which may cooperate with a clamp to hold such items in place on the user's clothing or body. The device provides a panel of woven material or mesh stretched within a plane and mounted to the rectangular frame. The post or hook of a jewelry item such as a pierced earring is inserted through the mesh, and the back or clamp, if provided, is attached from the back of the frame to hold the item in place on the display device. The display device may be held in an upright position on a horizontal surface by a back support leg or on a vertical surface in the fashion of a picture frame.

U.S. Pat. No. 4,687,103, issued Aug. 18, 1987 to Mary D. Corbett and entitled JEWELRY DISPLAY DEVICE also shows a generally rectangular display device including an inner planar mesh panel for receiving the pin-like shaft or hook of an earring or jewelry article. The illustrated display device includes an inner and outer frame, the inner frame supporting the mesh panel and the outer frame receiving the inner frame and providing a structure for maintaining the frame in an upright position on a horizontal surface, or may include a hook for hanging the display device against a vertical wall. In another embodiment, the display device includes on the outer frame a base which allows free standing vertical orientation of the display device.

U.S. Pat. No. 4,043,449, issued Aug. 23, 1977 to Michael Love and entitled GIFT PACKAGE CONTAINING MESSAGE BEARING UNIT AND USEFUL ARTICLE IN ASSOCIATION THEREWITH shows a box arrangement for holding earrings in combination with a greeting card-like message bearing portion. The disclosure shows a box structure receiving the card-like message portion with earrings attached through a panel of the card and a lid over the top of the assembly.

U.S. Pat. No. 4,181,224, issued Jan. 1, 1980 to Dick S. Aber and entitled APPARATUS FOR HOLDING PIERCED EARRINGS FOR DISPLAY AND/OR STORAGE shows a picture frame-like arrangement for removably retaining at least one pierced earring thereon. The retention arrangement of the disclosure includes at least two layers of sheet plastic material overlaying the base, and at least two layers of filler material interposed between the two layers of sheet plastic material and between the base and one of the layers of sheet plastic material, respectively. The layers of sheet plastic material have a plurality of holes therethrough with each hole in the inner layer of sheet plastic material being located in direct axial alignment with a corresponding hole in the outer layer of plastic material.

U.S. Pat. No. 4,287,986, issued Sep. 8, 1981 to William M. Beck and entitled EARRING DISPLAY CASE shows an earring and pendant display case, a substantially rectangular back panel and a pair of hinged substantially rectangular display panels which may be pivoted inward to enclose the display surfaces thereof. The entire arrangement, therefore, may be folded into a generally rectangular enclosure. Within the enclosure, there are provided various bars for receiving earrings thereon by penetrating the thickness of the bars with the post or shaft of the earring.

U.S. Pat. No. 4,311,235, issued Jan. 19, 1982 to Wanda L. Titus and entitled ORGANIZER JEWELRY BOX shows a jewelry tray for an organized containment of earrings for pierced ears. The tray surface includes recessed portions with each recessed portion including a pair of upward projecting pins or posts for receiving the clasp portion of the pin. An adjacent portion of the tray includes apertures for receiving the post portion of the decorative body of the earring. The edge of the tray includes a lip so that a plurality of such trays may be vertically stacked.

U.S. Pat. No. 4,324,446, issued Apr. 13, 1982 to George J. LeSage and entitled JEWELRY CASE shows a jewelry case for receiving, sorting, carrying and displaying jewelry. The case comprises a front portion and a back portion defining at least one compartment therebetween. The front portion comprises a pair of closure members hingedly mounted to the back portion to provide easy access to the compartments. The enclosures include hook-like formations for receiving necklaces and the like for storage. By storing necklaces and earrings in this case, the collection is maintained in an organized fashion and may be transported by transport of the jewelry case.

U.S. Pat. No. 4,420,084, issued Dec. 13, 1983 to Elizabeth M. Whelan and entitled JEWELRY HOLD- ING DEVICE shows a pair of rectangular frames coupled by hinges whereby the frames may be brought together to define an enclosure. The inner surfaces of each frame include a rigid sheet having apertures therein for receiving jewelry items.

All of the above jewelry display and storage devices may be characterized as being generally rigid in structure and of constant size regardless of the amount of jewelry stored therein.

U.S. Pat. No. 4,465,179, issued Aug. 14, 1984 to Beverly A. Miller and entitled JEWELRY HOLDER FOR PIERCED EARRINGS shows a small pouch-like container made of flexible material and has an interior with an access opening closable by a zipper. A flexible tab is connected to the container at the interior and is sized to fit wholly within the container, or alternatively extend substantially out of the interior through the access opening when the zipper is opened. The tab defines a pierced earring holder on which earrings may be mounted when the tab is on the exterior of the container and which firmly holds the earrings for storage when the tab is in the interior of the container and the zipper is closed.

SUMMARY OF THE INVENTION

In accordance with a preferred embodiment of the present invention, a jewelry display, storage and transportation apparatus is provided by a flexible screen panel surrounded by a flexible frame whereby an inventory of jewelry items may be attached to the screen in a selected, organized and easily accessible display arrangement, and the entire assembly can be rolled into a cylindric shape for storage or transportation of jewelry therein.

In accordance with one aspect of the present invention, the flexible jewelry display device may include tab formations each carrying a fastener which may be folded against the body of the display device and attached thereat to a complementary fastener such that the display device may be attached for display or storage to a horizontal rod, such as the horizontal portion of a hanger or towel rod. In accordance with another aspect of the present invention, the flexible jewelry display panel may be provided with the above-noted tabs carrying fastening devices and the display device may further include on its backside complementary back panel fastening devices whereby upon rolling the panel into a cylindric shape with the jewelry captured therein the tab fasteners may be attached to the back panel fasteners to secure the display device in its rolled configuration. The apparatus may further include eyelets for securing the arrangement to, for example, a wall by use of tacks for relatively more permanent display.

The subject matter of the present invention is particularly pointed out and distinctly claimed in the concluding portion of this specification. However, both the organization and method of operation of the invention, together with the further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION OF THE PREFERRED EMBODIMENT

Figure 1:
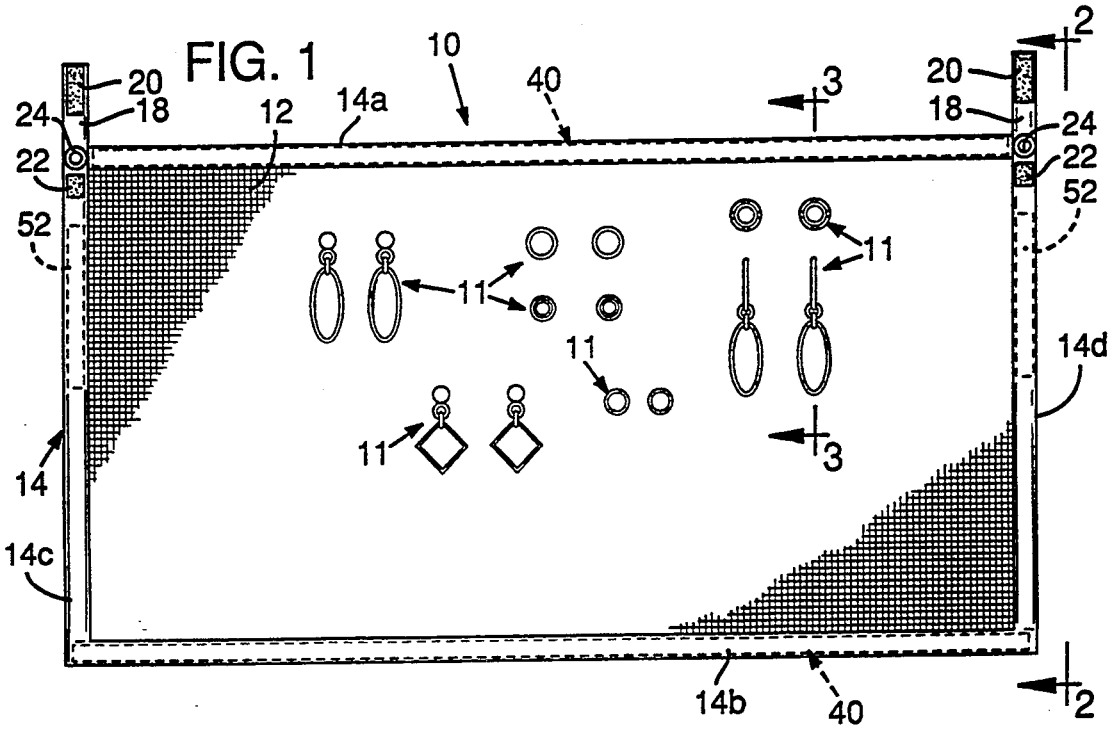
FIG. 1 is a front view of a flexible jewelry display and storage device according to a preferred embodiment of the present invention.

FIG. 1 illustrates a jewelry display and storage device 10 according to a preferred embodiment of the present invention. Device 10 comprises a flexible screen panel 12, shown partially in FIG. 1, such as that used for conventional lightweight plastic or fiberglass window screen, and also a surrounding fabric frame 14. The fabric frame includes a top fabric strip **14*a*, and bottom fabric strip 14*b*, a left side fabric strip 14*c*, and a right fabric strip 14*d*. Each of the above-noted fabric strips 14*a*–14*d* may be provided by wrapping a segment of decorative fabric about the corresponding edges of the screen 12 and stitched along the inner edge of each fabric strip to join the front and back portions of the strips to the screen 12. The stitches are indicated at reference numeral 16 in FIG. 3A. As may be appreciated, the screen 12 provides a convenient and secure structure for attachment of jewelry items 11 thereon. Such a screen is most suitable for attachment of jewelry items 11 having pin or shaft structures which may be inserted through the screen 12 for display and storage upon the device 10**.

The upper end of each side strip **14*c* and 14*d* extends beyond the top strip 14*a* to define one of two tabs 18. Each tab 18 carries on its front surface near the distal end a fastener 20. Spaced from each fastener 20 down along the corresponding strips 14*c* and 14*d* is a complementary fastener 22. In the preferred embodiment of the present invention, the fasteners 20 and 22 are such fasteners as provided under the trademark VELCRO wherein one of the two fasteners 20 and 22 would include hook-like structures and the other would include fibrous structures which may be brought together for attachment and torn apart for detachment. Intermediate each pair of fasteners 20 and 22 is an eyelet 24 extending through corresponding side strips 14*c* and 14*d***.

Figure 2:
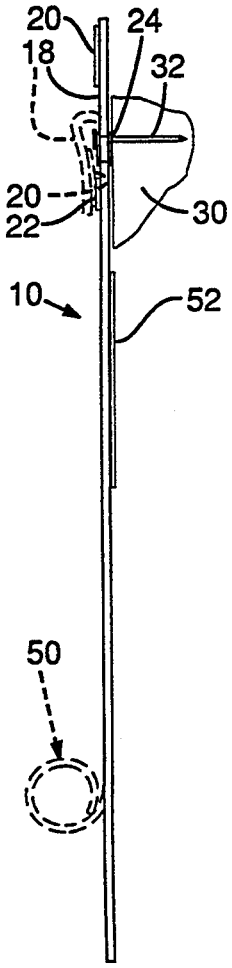
FIG. 2 is a side view of the display and storage device of FIG. 1 as taken along lines 2—2 of FIG. 1.

FIG. 2 is an end view of the device 10 as taken along lines 2—2 of FIG. 1 and illustrating attachment of the device 10 to a wall 30. More particularly, a pair of tacks 32 may be inserted through the corresponding eyelets 24 and into the wall 30 for hanging the device 10 upon wall 30 in vertical orientation. Also, the tabs 18 may fold downward over the tacks 32 as indicated in phantom to hide from view the heads of tacks 32.

Figure 3A:
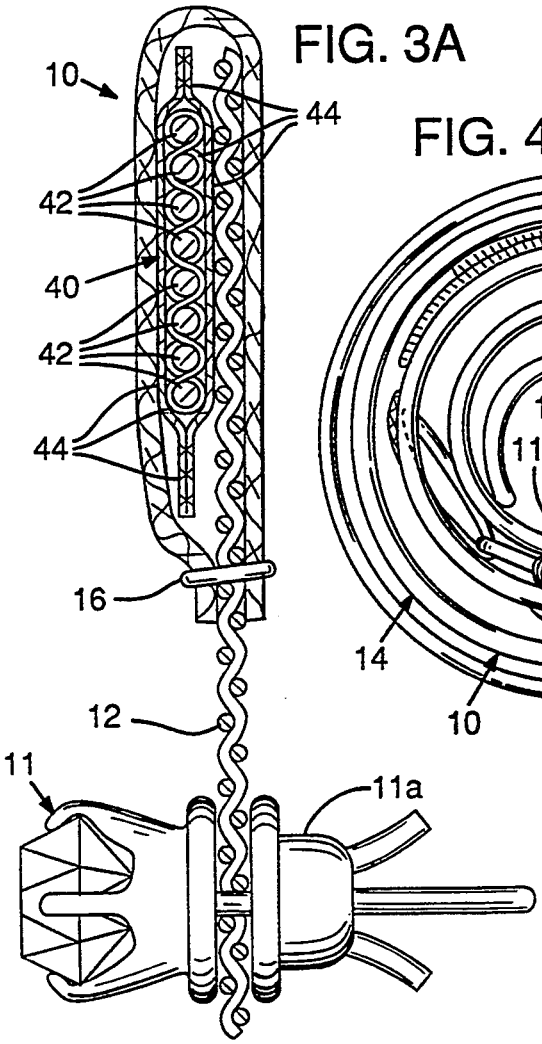
FIGS. 3A and 3B are sectional views of the display and storage device of FIG. 1 as taken along lines 3—3 of FIG. 1.
Figure 3B:
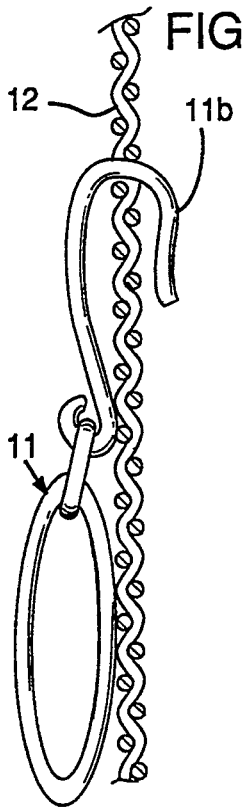

FIGS. 3A and 3B are continuous sectional views of the device 10 as taken along lines 3—3 of FIG. 1. FIG. 3A illustrates the use of stiffeners 40 secured within each of the strips 14*a* and 14*b*. The stiffeners 40 are flexible, but resist sagging of the display device 10 under the weight of jewelry items 11 attached to the panel 12. In the preferred embodiment of the present invention, the stiffeners 40 are polyester boning available from Selectus Limited, England under the trademark RIGILENE. Each stiffener 40 includes a plurality of plastic or filament rods 42 woven into a cloth mesh 44. FIG. 3A further illustrates the attachment of a jewelry item 11 having a post mounting structure and a backing 11*a*. FIG. 3B shows attachment of a jewelry item 11 having a hook-like mounting structure 11*b*.

Returning to FIG. 2, the display and storage device 10 may be rolled as indicated in phantom in FIG. 2 at the reference numeral 50. In rolling the device 10 in this manner, jewelry items 11 attached to the front of panel 12 are well secured and protected within the cylindric structure so formed in rolling the device 10. The back side of each side strip 14*c* and 14*d* carries a fastening strip 52 (FIGS. 1, 2 and 4) complementary to the fastener 20 of tabs 18. Thus, upon rolling the device 10 into a cylindric configuration, the fasteners 20 on the front side of tabs 18 may be brought against the fasteners 52 on the back side of the corresponding side strips 14*c* and 14*d* to maintain the device 10 in its rolled configuration.

Figure 4:
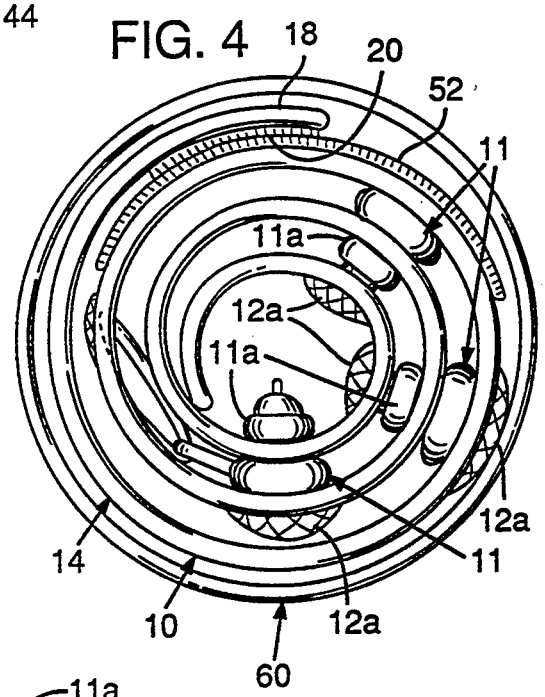
FIG. 4 is an end view of the cylindric configuration of the jewelry display and storage device in its rolled condition.

FIG. 4 illustrates the rolled configuration of the device 10 wherein the fasteners 20 are held against the fasteners 52 and the device assumes a spiral configuration with the jewelry items 11 held therein. As may be appreciated, due to the flexible character of the device 10, the panel 12 assumes the contour of the jewelry items 11 in such rolled configuration as a more efficient, i.e., compact, method of storage for jewelry items 11. More particularly, FIG. 4 illustrates the bulging of screen 12, indicated at the reference numeral 12a, to accommodate the shape of the jewelry items 11 as wrapped within the device 10. Also, in such rolled configuration the device 10 may be stored within a transport tube 60. The transport tube 60 may further include end caps (not shown) for securing device 10 within tube 60 during travel or storage.

Figure 5:
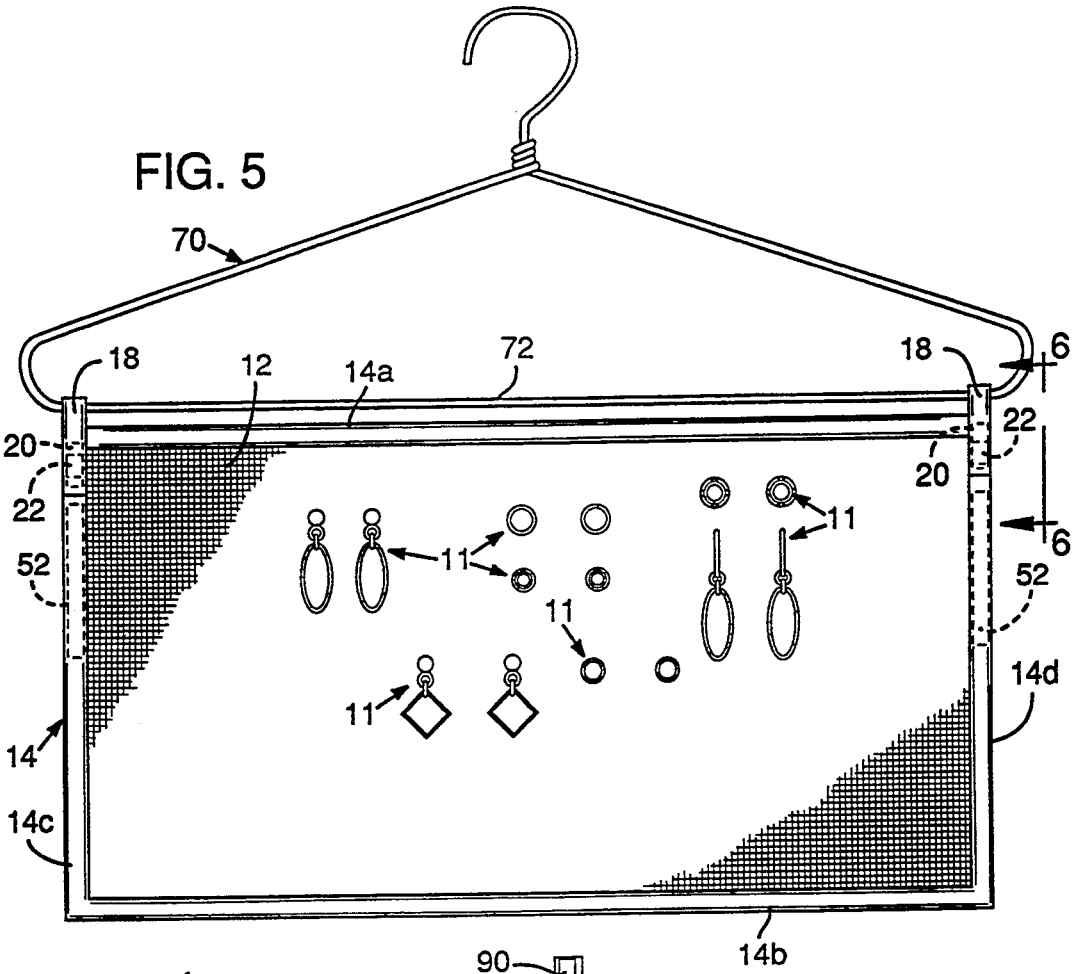
FIG. 5 illustrates attachment of the jewelry display and storage device of FIG. 1 to a clothes hanger.
Figure 6:
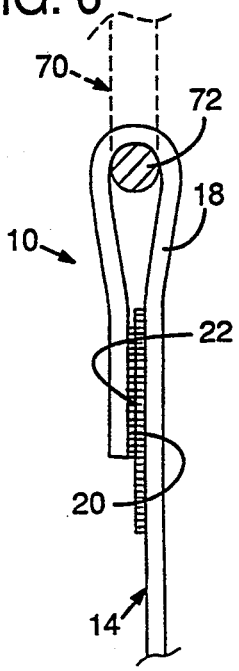
FIG. 6 is a side view of the jewelry display and storage device as shown in FIG. 5 and taken along lines 6—6 of FIG. 5.

FIG. 5 illustrates use of a conventional clothes hanger 70 including a lower horizontal rod 72 for supporting the device 10. More particularly, each of tabs 18 may be wrapped about the rod 72 as illustrated in the side view of FIG. 6 and the fasteners 20 attached to the corresponding fasteners 22 such that the device 10 depends from the rod 72. Thus, the device 10 may be conveniently stored or displayed by use of an implement, i.e., the clothes hanger 70, commonly available to travelers. As may be appreciated, by attaching the device 10 to a clothes hanger, the traveler may transport an inventory of jewelry items in, for example, a garment bag along with clothes not likely to be crushed. In this regard, the device 10 is well adapted for use by the traveling person desiring to carry a large inventory of jewelry, yet not wishing to tangle the jewelry and disorganize the inventory. Thus, the traveler has available a broad selection of earrings according to clothes selected for the day and/or evening wear, and according to the tenor of expected activities.

Figure 7:
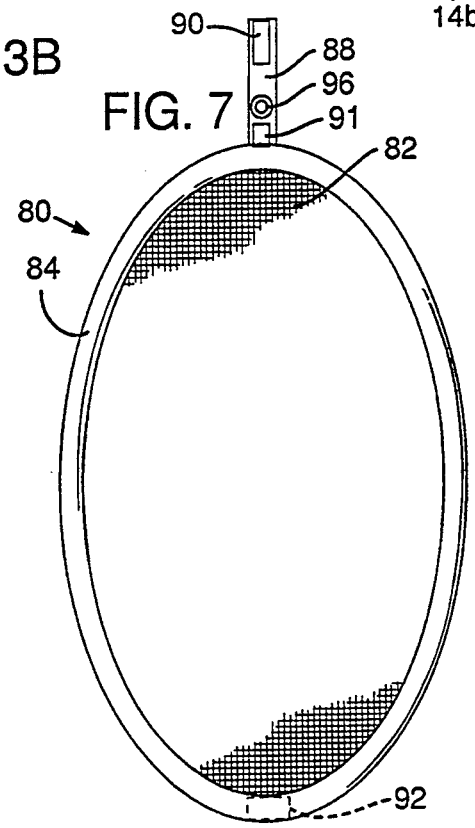
FIG. 7 illustrates an alternative embodiment of the present invention as provided in an oval shape and including a modified fastening arrangement.

While the preferred embodiment of the present invention has been shown in a generally rectangular configuration, it may be appreciated that a great variety of shapes and sizes of the display device 10 are possible. For example, FIG. 7 illustrates an oval shape for a similar display device 80 which includes a central mesh panel 82 (shown partially) and a surrounding oval fabric frame 84. The fabric frame 84 may encase a stiffener as provided by Crown Textile Company under the product name ARMOFLEXXX and suitably gathered to define a desired oval curvature. As with the device 10, the panel 82 receives the post or hook-like structures of jewelry items and may be rolled into a cylindric configuration for storage or transport thereof.

Device 80 includes a pair of tabs 88 each carrying on the rear side thereof an upper fastener 90 and a lower fastener 92. The fasteners 90 are complementary to the fasteners 92 whereby the tabs 88 may fold such that each fastener 90 engages the corresponding fastener 92. In this manner, the device 80 may depend from a rod structure, e.g., a clothes hanger or towel rod, by capturing the rod structure within the loops formed by the tabs 88 upon engaging each fastener 90 with the complementary fastener 92. Each tab 88 includes a pair of eyelets 94 which may be suitably positioned relative to the fasteners 90 and 92 such that upon engagement of the fasteners 90 with the corresponding complementary fasteners 92 the eyelets 94 are in alignment. In such configuration, the device 80 may be mounted to a wall structure by insertion of tacks (not shown) through the aligned eyelets 94. Finally, each tab 88 includes a fastener 96 on its front side which is complementary to the corresponding fastener 92 such that the device 80 may be rolled into cylindric configuration and retained in such configuration by engagement of each fastener 96 with the corresponding fastener 92.

Thus, an improved jewelry storage, display and transport device has been shown and described. The device is well adapted for storing, displaying and transporting pierced earrings and like items having a decorative front or a dangling decorative portion and having a pin-like shaft, hoop, or hook which may attach such decorative articles to the body or to the display device. The device provides a virtually infinite number of positions and relationships in which such items can be displayed. The display device may come in an infinite number of shapes, sizes, patterns and colors of fabric and may be displayed by suspending it from a vertical surface by small pins, i.e., the tacks 32 of FIG. 2, or hung in a closet from a clothes hanger, i.e., the hanger 70 of FIG. 5. While a specific fastening mechanism has been shown, it may be appreciated that a great variety of fastening mechanisms may be employed under the present invention. While the present invention has been shown and illustrated in connection with the storage and display of earrings, it will be appreciated that the device is well adapted for other personal ornamentation such as decorations, name tags, medals and the like which have a front decorative or informative portion and a pin, shaft or hook element. The display device is more useful and safer as suspended from a vertical surface. More particularly, as mounted to a wall surface, the display device is conveniently visible at eye level and may be positioned adjacent to, for example, the bathroom mirror or the inside of a closet or a cupboard. In such mounting, the device is less accessible by small children as compared to a display resting on a counter top.

The display device of the present invention is also less obviously accessible to burglars, and therefore less vulnerable to theft, by storing an inventory of jewelry items on a clothes hanger and storing this arrangement within a closet. The arrangement could, for example, be hidden within an article of clothing hanging within the closet. Such a jewelry storage arrangement is less likely to be accessed by a burglar than would a conventional jewelry display device which would typically be more bulky, rigid, and more likely to be left on a countertop. In contrast, the flat and flexible character of the present invention allows it to be hung along with articles of clothing which are less likely to be stolen or inspected by a burglar.

The display device of the present invention solves the problems of how to store, display and transport earrings during periods of travel. The display device allows the user to maintain an organized and large inventory of earrings either at home or on the road without disturbing the mounting or organization of the those earrings. The display device is easily taken down, rolled up and slipped into a travel tube to be quickly suspended later from, for example, any clothes hanging device with a horizontal structural member. The use of the fine textured, flexible window screening as illustrated herein is desirable for its amenability to these applications and for the ease with which jewelry items slip into and secure to the screen. Furthermore, the materials of the display device under the present invention are fully washable for ease of care and maintenance.

It will be appreciated that the present invention is not restricted to the particular embodiment that has been described and illustrated, and that variations may be made therein without departing from the scope of the invention as found in the appended claims and equivalents thereof. For example, for larger scale display and storage devices 10 more than two tabs 18 may be desired for more uniformly supporting the weight of a larger jewelry inventory. Also, as may be appreciated, a great variety of fasteners 20, 22 may be used in place of the illustrated fasteners, e.g., snaps would work well.

What is claimed is:

1. A jewelry display and storage device comprising:

a flexible screen panel suitable for mountably receiving an inventory of jewelry items in secure and organized fashion by coupling of hook or shaft structures of said jewelry items to said screen;

a flexible fabric frame surrounding and attached to said screen panel, said frame including at least one stiffening member for resisting sagging of said screen panel under the weight of an inventory of jewelry items mounted thereon;

first and second tab elements extending from said frame, each carrying respective ones of first and second tab fasteners;

first and second complementary fasteners mounted to said display and storage device proximate to and selectively attachable to said first and second tab fasteners, respectively, whereby said first tab fastener may join with said first complementary fastener forming by said first tab element a first loop and said second tab fastener may join with said second complementary fastener forming by said second tab element a second loop such that said device may depend from a rod-like structure from said first and second loops; and third and fourth complementary fasteners mounted to said display and storage device on a face thereof opposite that of said first and second tab fasteners, whereby said device may brought into a rolled cylindrical configuration and said first and second tab fasteners selectively attached to said third and fourth complementary fasteners, respectively, such that said device is maintained in said rolled cylindrical configuration.

2. A jewelry item display and storage device comprising:

a flexible screen panel defining a front face and a rear face of said display and storage device, said screen panel being suitable for receiving through preexisting apertures thereof hook or shaft structures of jewelry, said apertures being exposed at a front side and a back side of said screen panel;

a flexible frame surrounding the screen panel whereby the entire device may be rolled into cylindrical configuration for storage or transport, said flexible frame including a stiffening member generally parallel to a central axis of said display and storage device when rolled into said cylindrical configuration, said stiffening member resisting sagging of said screen panel under the weight of an inventory of jewelry items when mounted thereon;

first and second tab elements extending from said frame, each of said first and second tab elements having a front and rear surface comprising a portion of said front face and said rear face of said display and storage device, respectively;

first and second tab fasteners each mounted to a corresponding one of said front surfaces of said first and second tab elements;

first and second complimentary fasteners mounted to said front face of said display and storage device proximate to corresponding ones of said first and second tab fasteners whereby said first tab fastener may attach to said first complimentary fastener and said second tab fastener may attach to said second complimentary fastener thereby forming first and second loop structures comprising said tab elements such that said display and storage device may depend from a rod-like structure captured within said first and second looped structures; and third and fourth complimentary fasteners mounted to said rear face of said display and storage device, each of said third and fourth complimentary fasteners selectively attachable to a corresponding one of said first and second tab fasteners whereby said first and second tab fasteners may selectively attach to said third and fourth complimentary fasteners when said device is rolled into said cylindrical configuration and thereby maintain said display and storage device in said cylindrical configuration.

3. The device according to claim 2 wherein said flexible frame is a decorative fabric frame comprising fabric strips sewn to said screen panel.

4. The device according to claim 2 further comprising a mounting arrangement for attachment to a vertical surface.

5. The device according to claim 4 wherein said mounting arrangement comprises at least one eyelet structure for attachment of said device by at least one tack therethrough and into said vertical surface.

6. A jewelry display and storage device comprising:

a flexible screen panel suitable for mountably receiving an inventory of jewelry items in secure and organized fashion by passing hook or shaft structures of said jewelry items through preexisting apertures of said screen panel, said apertures being exposed at front and back sides of said screen panel;

a flexible fabric frame surrounding and attached to said screen panel, said frame including at least one stiffening member for resisting sagging of said screen panel under the weight of an inventory of jewelry items mounted thereon;

first and second tab elements extending from said frame, each carrying respective ones of first and second tab fasteners;

first and second complementary fasteners mounted to said display and storage device proximate to and selectively attachable to said first and second tab fasteners, respectively, whereby said first tab fastener may join with said first complementary fastener forming by said first tab element a first loop and said second tab fastener may join with said second complementary fastener forming by said second tab element a second loop such that said device may depend from a rod-like structure from said first and second loops; and third and fourth complementary fasteners mounted to said display and storage device on a face thereof opposite that of said first and second tab fasteners, whereby said device may brought into a rolled cylindrical configuration and said first and second tab fasteners brought together and attached to said third and fourth complementary fasteners, respectively, such that said device is maintained in said rolled cylindrical configuration.

* * * * *